US007642437B2

(12) United States Patent
Terada

(10) Patent No.: US 7,642,437 B2
(45) Date of Patent: Jan. 5, 2010

(54) MUSICAL INSTRUMENT

(75) Inventor: Norishige Terada, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 11/678,472

(22) Filed: Feb. 23, 2007

(65) Prior Publication Data

US 2007/0204743 A1 Sep. 6, 2007

(30) Foreign Application Priority Data

Mar. 6, 2006 (JP) ..... 2006-059542

(51) Int. Cl.
*G10C 3/02* (2006.01)
*G10D 13/08* (2006.01)

(52) U.S. Cl. ..... 84/179; 84/177; 84/178; 84/404; 84/379; 84/410

(58) Field of Classification Search ..... 84/371, 84/404, 410, 376 R, 177–179
See application file for complete search history.

(56) References Cited

U.S. PATENT DOCUMENTS 149,232 A * 3/1874 Lincoln ..... 84/404
247,473 A * 9/1881 Bourne ..... 84/178
324,052 A * 8/1885 Umland ..... 84/178
399,710 A * 3/1889 Steck ..... 84/404
579,031 A * 3/1897 Zintzsch ..... 84/404
604,166 A * 5/1898 Bauer ..... 84/178
671,234 A * 4/1901 Reeps ..... 84/178
769,129 A * 8/1904 Colwell ..... 84/404
788,348 A * 4/1905 Bollermann ..... 84/178
1,090,343 A * 3/1914 Ponsiglione et al. ..... 84/178
1,134,351 A * 4/1915 Schlensker ..... 84/404
1,173,507 A * 2/1916 Haskell ..... 84/170
1,275,806 A * 8/1918 Weiser ..... 84/178
1,285,299 A * 11/1918 Marx ..... 84/404
1,369,268 A * 2/1921 Deagan ..... 84/410
1,578,317 A * 3/1926 Johanson et al. ..... 84/178
1,664,587 A * 4/1928 Blalack et al. ..... 84/404
1,707,057 A * 3/1929 Fusch ..... 84/404
1,791,720 A * 2/1931 Exter ..... 84/404
2,052,890 A * 9/1936 Marks ..... 446/298
2,287,138 A * 6/1942 Sas ..... 84/410
2,469,667 A * 5/1949 Rhodes ..... 84/404
2,474,462 A * 6/1949 Brewer ..... 84/404

(Continued)

FOREIGN PATENT DOCUMENTS

CN 1677481 A 10/2005

(Continued)

*Primary Examiner*—Jeffrey Donels
*Assistant Examiner*—Robert W Horn
(74) *Attorney, Agent, or Firm*—Dickstein Shapiro LLP

(57) ABSTRACT

A musical instrument having a displacement member that is operable to vary sounds, thereby offering a wide variety of musical performances. A box-shaped sound generation unit accommodated in the inside of a musical instrument body generates a sound in response to any one of performance operators being operated. At least part of a displacement member provided for displacement relative to the musical instrument body is always disposed within the inside of the musical instrument body. When an operating section is operated to cause the displacement member to be displaced as a sound is generated from the sound generation unit, the sound varies according to the displacement of the displacement member.

4 Claims, 4 Drawing Sheets

U.S. PATENT DOCUMENTS

| | | | | | |
|---|---|---|---|---|---|
| 2,541,143 | A | * | 2/1951 | Zimmerman | 84/404 |
| 2,601,185 | A | * | 6/1952 | Van Den Bergh | 84/237 |
| 2,641,153 | A | * | 6/1953 | Enochs et al. | 84/403 |
| 2,785,595 | A | * | 3/1957 | Smith | 84/402 |
| 2,800,827 | A | * | 7/1957 | Haselton | 84/404 |
| 2,837,004 | A | * | 6/1958 | Volpe | 84/404 |
| 2,850,933 | A | * | 9/1958 | Anderson | 84/404 |
| 2,873,639 | A | * | 2/1959 | Musser | 84/404 |
| 2,902,897 | A | * | 9/1959 | Volpe | 84/404 |
| 2,929,291 | A | * | 3/1960 | Busilacchio | 84/376 R |
| 2,950,643 | A | * | 8/1960 | Scherer | 84/376 R |
| 2,984,141 | A | * | 5/1961 | Loeffelholz | 84/376 R |
| 3,055,252 | A | * | 9/1962 | Marsich | 84/404 |
| 3,230,921 | A | * | 1/1966 | Spiegel | 116/67 R |
| 3,306,151 | A | * | 2/1967 | Cser | 84/404 |
| 3,365,995 | A | * | 1/1968 | Lindermeier et al. | 84/376 R |
| 3,420,135 | A | * | 1/1969 | Wolf | 84/478 |
| 3,858,477 | A | * | 1/1975 | Kawakami | 84/410 |
| 3,981,221 | A | * | 9/1976 | Wittel | 84/423 R |
| 4,159,664 | A | * | 7/1979 | Mastronardi | 84/376 R |
| 4,240,321 | A | * | 12/1980 | Goldenberg | 84/433 |
| 4,343,221 | A | * | 8/1982 | Komatsu et al. | 84/404 |
| 4,625,617 | A | * | 12/1986 | Hara et al. | 84/404 |
| 5,235,892 | A | * | 8/1993 | Terada et al. | 84/404 |
| 5,313,867 | A | * | 5/1994 | Terada et al. | 84/404 |
| 5,824,927 | A | * | 10/1998 | Tonon | 84/375 |
| 6,660,917 | B2 | * | 12/2003 | Goto et al. | 84/179 |
| 6,686,521 | B2 | * | 2/2004 | Sandifer | 84/179 |
| 7,161,078 | B2 | * | 1/2007 | Becker-Ehmck | 84/410 |
| 7,301,084 | B2 | | 11/2007 | Okada | |
| 2007/0204743 | A1 | * | 9/2007 | Terada | 84/423 R |
| 2009/0165628 | A1 | * | 7/2009 | Kenagy et al. | 84/177 |

FOREIGN PATENT DOCUMENTS

| | | |
|---|---|---|
| EP | 1 246 161 | 10/2002 |
| JP | 04-212994 | 8/1992 |

* cited by examiner

MUSICAL INSTRUMENT

BACKGROUND OF THE INVENTION

1. Field of the Invention

The present invention relates to a musical instrument having an instrument body in which a box-shaped sound generation unit is accommodated.

2. Description of Related Art

Conventionally, a musical instrument has been known that has a body thereof accommodating a box-shaped sound generation unit, which is adapted to generate a sound when a performance operator is operated. For example, a musical instrument having a body thereof accommodating a resonance box is disclosed in Japanese Laid-open Patent Publication No. H04-212994. This musical instrument is configured to be a keyboard type and the resonance box is disposed close to tone plates. When any one of keys is operated, a corresponding tone plate is struck by a corresponding hammer, and the struck tone plate vibrates to produce a musical tone that resonates in the resonance box and is emitted as a sound to the outside via openings formed in the instrument body.

In the foregoing prior art musical instrument, however, musical tones generated by tone plates are attenuation sounds that themselves are monotonous, and it is not possible to give variety to sounds (for example, variety in sound volume) produced by resonation in the resonance box. As a result, musical performance is likely to be monotonous, and therefore, there is a room to make improvements to offer a wide variety of performances.

SUMMARY OF THE INVENTION

An object of the present invention is to provide a musical instrument having a displacement member that is operable to vary sounds, thereby offering a wide variety of musical performances.

To attain the object, according to the present invention, there is provided a musical instrument (10) comprising a musical instrument body (10*a*) having an inside, a plurality of performance operators (27, 28) provided in the musical instrument body, a box-shaped sound generation unit (30), accommodated in the inside of the musical instrument body, for generating a sound in response to any one of the plurality of performance operators being operated, at least one displacement member (46, 146) provided for displacement relative to the musical instrument body, at least part of the displacement member being always disposed within the inside of the musical instrument body, and an operating section (40) for causing the displacement member to be displaced, wherein when the operating section is operated to cause the displacement member to be displaced as a sound is generated from the sound generation unit, the sound varies according to displacement of the displacement member.

With this construction, it is possible to vary sounds by operating the displacement member, thereby offering a wide variety of performances.

Preferably, the musical instrument body has at least one opening (OP0) through which a sound generated from the sound generation unit is emitted to outside, and includes an opening varying member (44) provided for displacement relative to the musical instrument body, the opening varying member cooperating with the displacement member to change an effective open state of the opening.

With this construction, it is possible to emphasize a change in sound.

Preferably, the opening varying member is configured to function as the operating section.

With this construction, it is possible to suppress the arrangement from being complicated.

Preferably, the musical instrument is configured to be a keyboard musical instrument type and the plurality of performance operators are configured to be keys, and the musical instrument body is provided with a fallboard (UNT) for covering the plurality of performance operators, the fallboard being comprised of a front fallboard (44) that functions as the operating section and a rear fallboard (46) that functions as the displacement member, the front and rear fallboards are coupled together such that the rear fallboard is displaced in unison with the front fallboard when the front fallboard is operated.

With this construction, the fallboard can also function as a sound changing member, thereby making it possible to vary sounds, thus offering a wide variety of performances while suppressing the construction from being complicated. The phrase "to vary sounds" indicates not only to vary sound volume and tone color but also to attain acoustic effects of sound vibration such as vibrate and tremolo.

Preferably, the musical instrument body is provided with a plurality of percussion units (24) that correspond to respective ones of the plurality of performance operators and are each driven in response to a corresponding one of the plurality of performance operators being operated, the sound generation unit is comprised of a plurality of sounding members (31) provided so as to correspond to respective ones of the plurality of percussion units and a resonance box (32) for causing a musical tone produced from any one of the plurality of sounding members to resonate therein, the resonance box having an opening (32*a*) side, each of the plurality of sounding members vibrates and sounds a musical tone of a specific tone pitch when struck by a corresponding one of the percussion units in response to a corresponding one of the plurality of performance operators being operated, and the resonance box is arranged to have the opening side thereof disposed close to the sounding members.

With this construction, it is possible to give variety to musical tones, which are monotonous in a tone plate percussion musical instrument or the like, making it possible to offer a wide variety of performances.

The above and other objects, features, and advantages of the invention will become more apparent from the following detailed description taken in conjunction with the accompanying drawings.

DETAILED DESCRIPTION OF PREFERRED EMBODIMENT

The present invention will now be described in detail below with reference to the drawings showing a preferred embodiment thereof.

Figure 1:
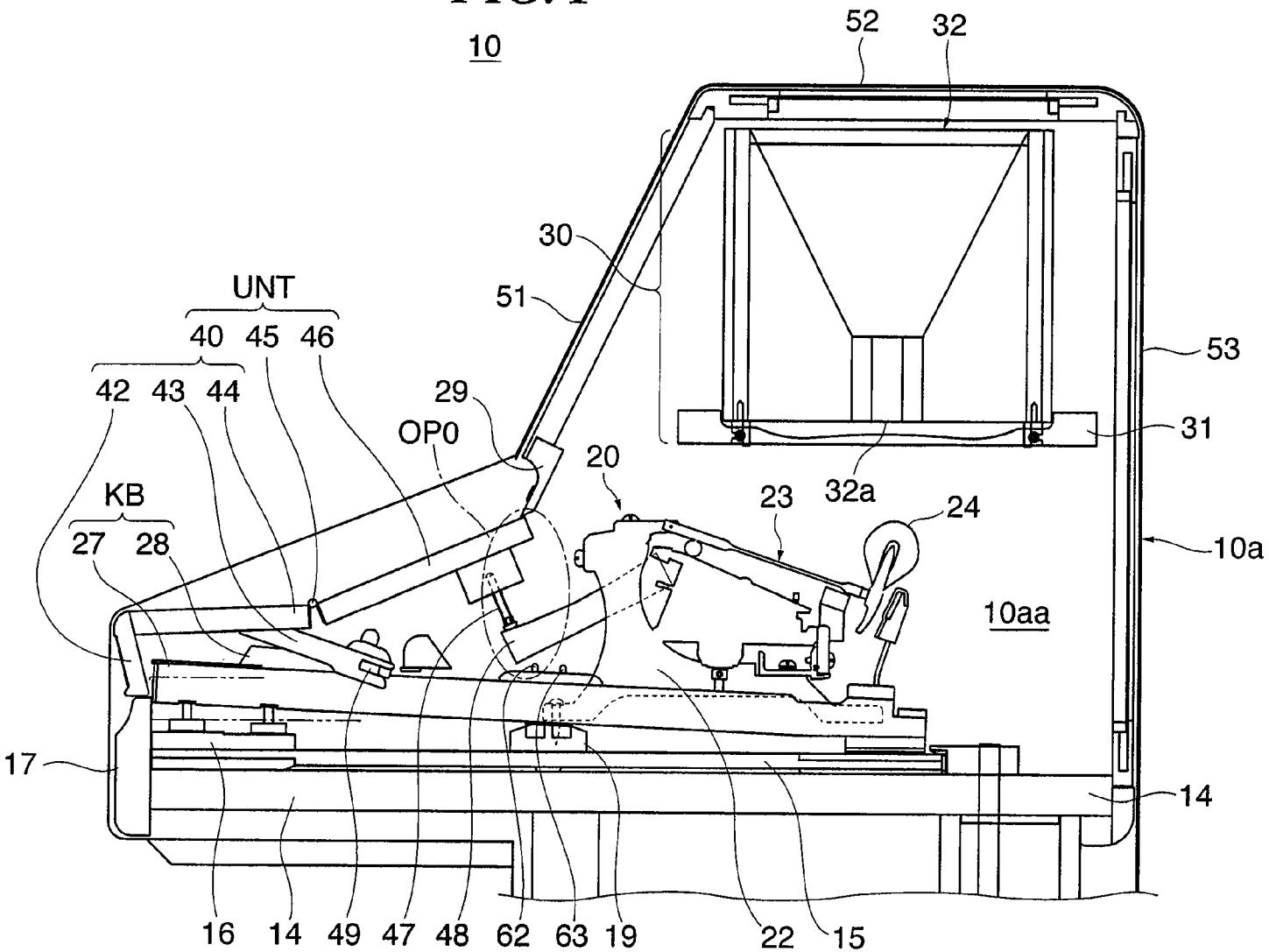
FIG. 1 is a fragmentary section view showing the internal construction of a body of a keyboard instrument as a musical instrument according to an embodiment of the present invention in a state where a fallboard of a fallboard unit is closed.
Figure 2:
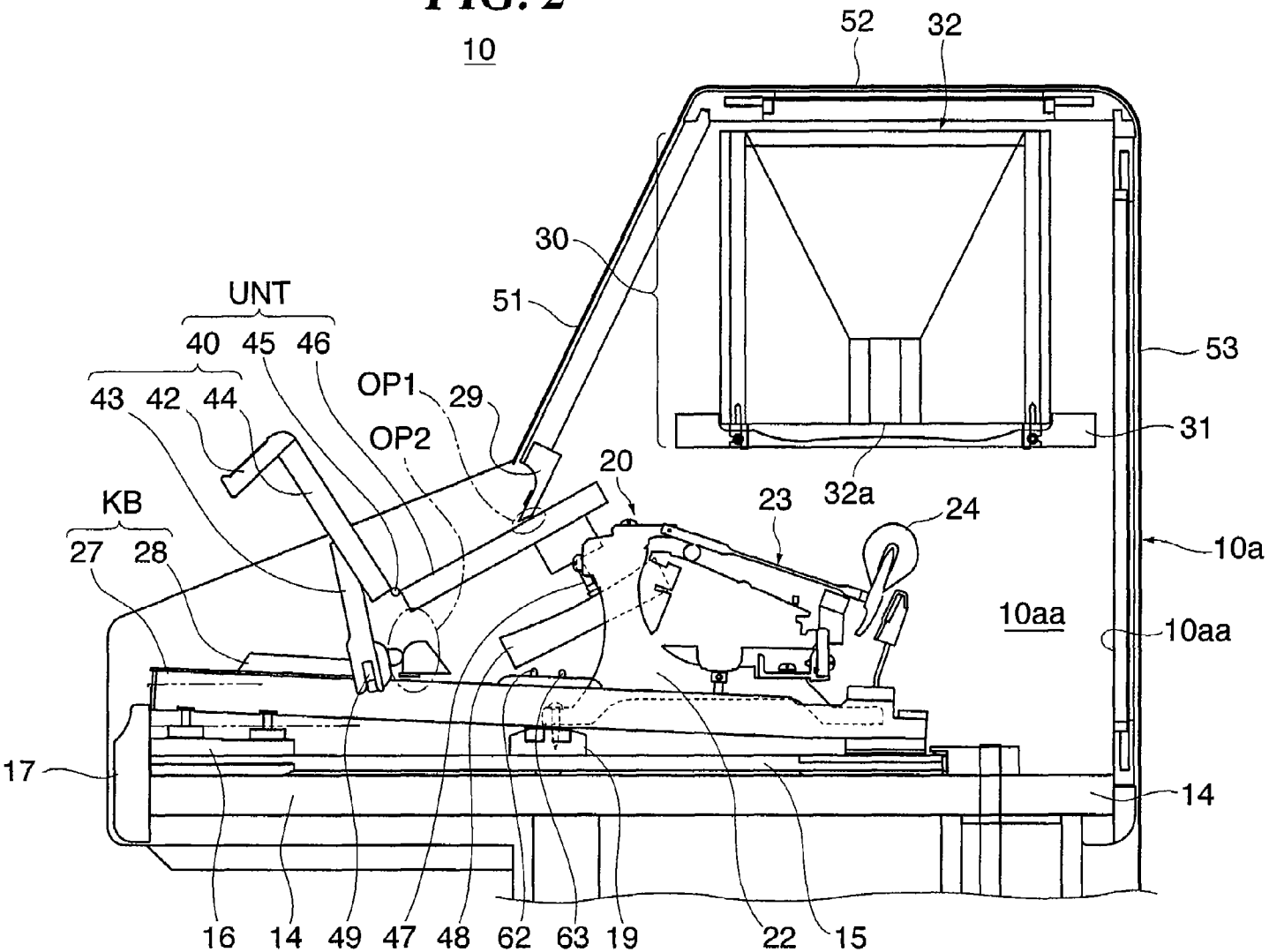
FIG. 2 is a fragmentary section view showing the internal construction of the body of the keyboard instrument according to the embodiment in a state where the fallboard unit is in the course of being opened.
Figure 3:
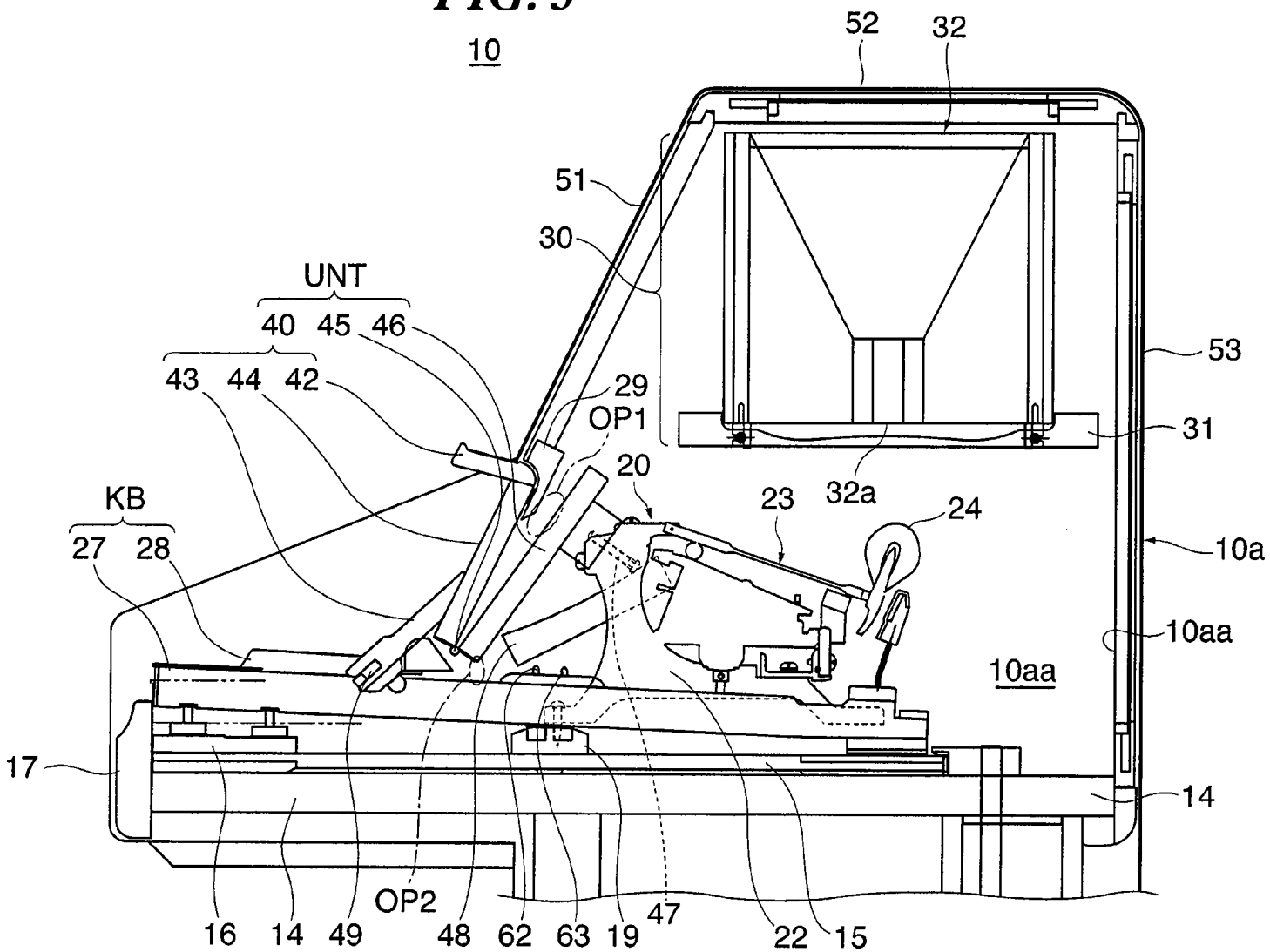
FIG. 3 is a fragmentary section view showing the internal construction of the body of the keyboard instrument according to the embodiment in a state where the fallboard unit is open.

FIGS. 1-3 are section views showing the internal construction of a body of a keyboard instrument, which is a musical instrument according to an embodiment of the present invention. Roughly speaking, this keyboard instrument 10 is configured as a keyboard-type tone plate percussion instrument, which is similar to a celesta and analogous in appearance to an upright piano, but does not include any strings. Instead, the keyboard instrument 10 includes tone plates similar to those of a celesta. The tone plates are provided in the instrument body 10*a*, which is located in an upper half of the keyboard instrument 10. When struck, each tone plate vibrates and generates a musical tone. The keyboard instrument 10 further includes a resonance box that causes a musical tone generated by a corresponding tone plate to resonate therein. As mechanisms for striking the tone plates, there are provided mechanisms similar to action mechanisms for a grand piano but not for an upright piano. In the following, the side of the keyboard instrument 10 toward a player is referred to as the front side, and the left and right directions are determined in reference to the player.

As shown in FIGS. 1 to 3, the keyboard instrument 10 includes a fallboard unit UNT. FIGS. 1 to 3 show the fallboard unit UNT in a fallboard closed state, a fallboard halfway open state, and a fallboard open state, respectively.

In a lower part of the instrument body 10*a*, a keybed 14 is provided on which a key frame 15 is disposed, and a front rail 16 is disposed on the front side of the key frame 15. The key frame 15 is provided with a balance rail 19 that supports a plurality of performance operators (white keys 27 and black keys 28) of a keyboard KB for vertical pivotal motion (seesaw motion) around respective ones of balance pins 62, 63 provided in the balance rail 19. A front end edge of the front rail 16 is covered by a keyslip 17 over the entire width of the keys.

Action mechanisms 20 and action brackets 22 are disposed upward of a rear half of the key frame 15, so as to correspond to respective ones of the keys 27, 28. The action mechanisms 20 are the same in construction as those of a grand piano. A tone generator unit 30 is disposed upward and slightly rearward of the action mechanisms 20 and provided with a wood resonance box 32 and a plurality of tone plates 31, which are sounding members. The tone generator unit 30 functions as a sound generation unit. The tone plates 30 are so arranged as to correspond to respective ones of the keys 27, 28. Each action mechanism 20 includes a percussion unit that is comprised of a hammer 23 having a hammer felt 24. When any one of the keys 27, 28 is depressed, a corresponding hammer 23 is pivoted upward and its hammer felt 24 strikes a corresponding tone plate 30, which vibrates and generates a musical tone that resonates in the resonance box 32.

In the tone generator unit 30, the tone plates 31 are mounted for vibration to the resonance box 32. The resonance box 32 has a length thereof corresponding to a distance between right and left side plates of the instrument body 10*a*. Using screws or the like, the resonance box 32 is fixed at its left and right sides to respective supports (not shown) provided inward of the side plates of the instrument body 10*a*, whereby the tone generator unit 30 is received in the instrument body 10*a*.

The instrument body 10*a* includes an upper front plate 51, a ceiling plate 52, and a rear plate 53. A blindfold 29 is fixed to a lower edge of the upper front plate 51 and extends over substantially the entire width of the instrument body 10*a*. Between a lower edge of the blindfold 29 and upper surfaces of the white keys 27, a front opening OP0 is defined through which the interior of the instrument body 10*a* is open toward a player (the front side of the instrument) when assumed that the fallboard unit UNT is removed from the instrument 10 (refer to FIG. 1). The upper front plate 51, ceiling plate 52 and rear plate 53 of the instrument body 10*a* cooperate with the blindfold 29 and a rear half of the keybed 14 to define an accommodation space 10*aa* in which the tone generator unit 30 is received.

The ceiling plate 52 and rear plate 53 of the instrument body 10*a* are formed with a plurality of openings (not shown) through which sounds from the resonance box 32 are emitted to the outside. When the keyboard instrument 10 is in the fallboard open state or the fallboard halfway open state, the front opening OP0 is not fully interrupted by the fallboard unit UNT. The front opening OP0 not fully interrupted functions as another opening for sound emission to the outside (as will be described in detail later).

The tone plates 30 are equal in number to the keys. Each tone plate 30 vibrates when struck by the corresponding hammer felt 24 and generates a musical tone of a specific tone pitch since the tone plates 30 are different from one another in shape such as the entire length or the like although they are all rectangular in cross section.

Though an illustration is omitted, the resonance box 32 is comprised of a low-pitch range portion formed by a Helmholtz type resonance box, a mid-pitch range portion formed by a closed-tube type resonance box, and a high-pitch range portion formed by a single-type resonance box. The low-pitch and mid-pitch range portions are each provided with resonance chambers that are the same in number as associated tone plates 31, whereas the high-pitch range portion is provided with a single resonance chamber that is common to associated tone plates 31. All the tone plates 31 are disposed close to lower openings 32*a* of the resonance box 32 and mounted for vibration to front and rear lower ends of the resonance box 32 using, for example, a coupling cord and a number of fasteners so as to be suspended from the resonance box.

The left and right side plates of the instrument body 10*a* are each provided with a guide 48 and a pivot shaft 49. The guides 48 are respectively fixed to the left and right side plates of the instrument body 10*a*. As seen from lateral side (refer to FIG. 1), the guide 48 extends from a location near the front opening OP0 to a location deeper into the interior of the instrument body 10*a*, with an upper surface of the guide 48 obliquely extending upward toward the rear of the instrument body 10*a*. As seen from lateral side, the pivot shaft 49 is disposed at a location forward of the front opening OP0 and near the longitudinal center of a front half of the white key 27. The pivot shafts 49 are respectively mounted to the left and right side plates of the instrument body 10*a* for pivotal motion in the clockwise and counterclockwise directions as viewed in FIG. 1.

The fallboard unit UNT is mainly comprised of a front fallboard assembly 40 (operating section), a coupling device 45, and a rear fallboard 46 (displacement member). The front fallboard assembly 40 includes a fallboard front part 42, left and right pivoting support members 43, and a front fallboard 44 (opening varying member). The fallboard front part 42, the front fallboard 44, and the rear fallboard 46 each have a width slightly larger than the entire width of the keyboard KB. The front and rear fallboards 44, 46 are coupled through the coupling device 45 such as a hinge, so as to be pivotable from each other. The fallboard front part 42 is mounted to a front end edge of the front fallboard 44, and the left and right pivoting support members 43 are respectively mounted to left and right side portions of the front fallboard 44. Furthermore, left and right guided members 47 are provided on left and right end portions of a rear surface of the rear fallboard 46.

The pivoting support members 43 each have one end thereof engaged with the pivot shaft 49 and another end thereof fixed to the side portion of the front fallboard 44. The front fallboard 44 and the pivoting support members 43 are pivotable around the pivot shaft 49 in unison therewith. The guided members 47 are always in contact with respective ones of upper surfaces of the guides 48.

To open and close the fallboard unit UNT, a user ordinarily grasps the fallboard front part 42 of the front fallboard assembly 40. By a fallboard opening operation with the fallboard front part 42 grasped, the front fallboard 44 is caused to be pivoted upward from a fallboard closed state where the keyboard KB is covered by the fallboard unit UNT (refer to FIG. 1). With the pivotal motion of the front fallboard 44, the rear fallboard 46 coupled to the front fallboard 44 via the coupling device 45 is caused to move rearward. At that time, the guided members 47 mounted to the rear fallboard 46 are in sliding contact with the guides 48, thereby determining the posture of the rear fallboard 46. The rear fallboard 46 is moved smoothly in the rearward direction while changing the posture thereof (refer to FIGS. 2 and 3).

As shown in FIG. 3, when the fallboard front part 42 is in contact with the blindfold 29, the fallboard unit UNT is in a fallboard open state. As shown in FIGS. 1 to 3, in the course of a fallboard opening process from the fallboard closed state to the fallboard open state, the front fallboard 44 is pivoted clockwise from a horizontal position, with its inclination angle gradually increasing. In the fallboard open state, the front fallboard 44 is positioned on an imaginary extension line extending downward from the upper front plate 51.

In the fallboard closed state, the rear fallboard 46 assumes a posture where it is slightly inclined such that a front end thereof is positioned slightly lower than a rear end thereof in the vertical direction. The rear fallboard 46 gradually increases in inclination angle in the fallboard opening process, and has an inclination angle close to that of the upper front plate 51 in the fallboard open state. As a result, the front and rear fallboards 44, 46 are in a folded state where they are disposed close to and face each other. In the fallboard closed state, a rear end portion of the rear fallboard 46 is positioned at the front opening OP0. On the other hand, in the fallboard open state, a longitudinally central portion of the rear fallboard 46 is positioned at the front opening OP0.

In order to close the fallboard, the user carries out a reverse operation as compared to the fallboard opening operation while grasping the fallboard front part 42. In the fallboard closing process, the guided members 47 are in sliding contact with the guides 48, and the fallboard unit UNT operates reversely as compared to the fallboard opening process.

Usually, the keyboard section KB is operated for performance in the fallboard open state shown in FIG. 3. In the present embodiment, the degree of opening of the fallboard unit UNT can be changed in order to give variety to musical tones during the performance. Specifically, when musical tones are sounded during the keyboard performance, the player can operate the fallboard front part 42 back and forth to move the fallboard unit UNT between the fallboard open state (refer to FIG. 3) and the fallboard halfway open state (refer to FIG. 2), for instance. With the movement of the fallboard unit UNT, it is possible to change a condition in which musical tones sounded from the resonance box 32 are emitted.

As shown in FIG. 2, in the fallboard halfway open state, a small first opening OP1 is formed between the blindfold 29 and the rear fallboard 46. Furthermore, a second opening OP2 is formed between a lower edge of the rear fallboard 46 and the white keys 27. As a result of the openings OP1 and OP2 being formed, the accommodation space 10*aa* is made open toward the player. In other words, an effective open state of the front opening OP0 (refer to FIG. 1) varies depending on the position and posture of the fallboard unit UNT. In the fallboard halfway open state, the first and second openings OP1 and OP2 constitute openings through which musical tones are emitted in the forward direction. As a result, musical tones from the resonance box 32 are emitted toward the player through the first and second openings OP1, OP2.

As shown in FIG. 3, in the fallboard open state, the first opening OP1 is certainly formed between the blindfold 29 and the rear fallboard 46. However, a gap through which the first opening OP1 is open to the outside is not present between the blindfold 29 and upper edges of the fallboard front part 42 and the front fallboard 44. As a consequence, the sound emitting function of the first opening OP1 cannot be attained. Although an illustration is omitted, in the course of shifting from the fallboard open state toward the fallboard halfway open state, a gap is formed between the blindfold 29 and the upper edges of the fallboard front part 42 and the front fallboard 44. Thus, the first opening OP1 can offer the sound emitting function during musical performance except when the fallboard unit is in the fallboard closed state or the fallboard open state.

The second opening OP2 becomes smaller with the advance of a shift from the fallboard halfway open state to the fallboard open state. Thus, the second opening OP2 is smaller in the fallboard open state than in the fallboard halfway open state. Nevertheless, the second opening can always offer the sound emitting function so long as musical performance is performed in a fallboard state varying from the fallboard halfway open state to the fallboard open state.

Musical tones sounded from the resonance box 32 are not only emitted in the upward direction but also emitted via the lower openings 32*a*. One of sound propagation paths is formed between the openings 32*a* and the front opening OP0 (refer to FIG. 1). Since always located near the front opening OP0, the rear fallboard 46 is always positioned in the sound propagation path. Furthermore, during the shift from the fallboard halfway open state to the fallboard open state, there occurs a change not only in the position of the rear fallboard 46 but also in the posture (inclination angle) thereof. This causes a change in a condition in which musical tones sounded from the openings 32*a* of the resonance box 32 are interrupted and/or reflected by the rear fallboard 46.

The movement of the rear fallboard 46 causes a change in the condition of sound interruption/reflection. In combination with this change in the sound interruption/reflection condition, the aforementioned change in the effective open state of the front opening OP0 produces complicated sound variations, thereby changing a condition in which musical tones are emitted to the outside. Specifically, mainly the volume and color tone of musical tones vary with movement of the fallboard unit UNT. By reciprocating the fallboard unit UNT back and forth while musical tones are being produced, the player can give variety (such as volume increase/decrease and tone color change) to musical tones which are usually acoustically monotonous. Furthermore, when manually operating the fallboard unit UNT, the player can freely control the moving range and moving speed of the fallboard unit UNT. Therefore, a variety of rich performance expressions can be offered.

Sound variations realized by the reciprocal movement of the fallboard unit UNT not only include volume change and tone color change, but also include sound variations along time axis. As the time axis vibrations, vibrate and tremolo can be mentioned, for instance. The sound vibrations along time axis are suitable since they are likely to be perceived by listeners, especially in a case where the musical instrument is configured as a celesta, a glockenspiel, or the like, which produces a slowly attenuating sound.

According to the present embodiment, at least part of the rear fallboard 46 of the fallboard unit UNT is always located in the accommodation space 10*aa*. As a result, when the fallboard unit UNT is moved while musical tones are being produced from the resonance box 32, the displacement of the fallboard unit UNT causes a corresponding change in the musical tones. Especially in the keyboard instrument 10 which is a tone plate percussion musical instrument, it is possible to give variety to monotonous musical tones sounded by tone plates 30, making it possible to realize a musical performance with a variety of rich performance expressions. Furthermore, the front fallboard 44 cooperates with the rear fallboard 46 to change the effective open state of the front opening OP0 (refer to FIG. 1), thus making it possible to much emphasize changes in musical tones.

In addition that the front fallboard 44 serves to change the effective open state of the front opening OP0, the rear fallboard 46 is displaced in unison with the front fallboard assembly 40 when the latter is operated. This makes it possible to use the fallboard unit UNT as a sound varying member whereby the musical instrument can be prevented from being complicated in construction.

Solely from the viewpoint of making sounds from the tone generator unit 30 variable, a displacement member may be provided separately from the fallboard unit UNT, instead of configuring the fallboard unit UNT to achieve such function. For instance, the displacement member may be disposed in a propagation path of sounds produced from the tone generator unit 30, and an operating device may be provided for drivingly operating the displacement member in a musical performance.

Figure 4:
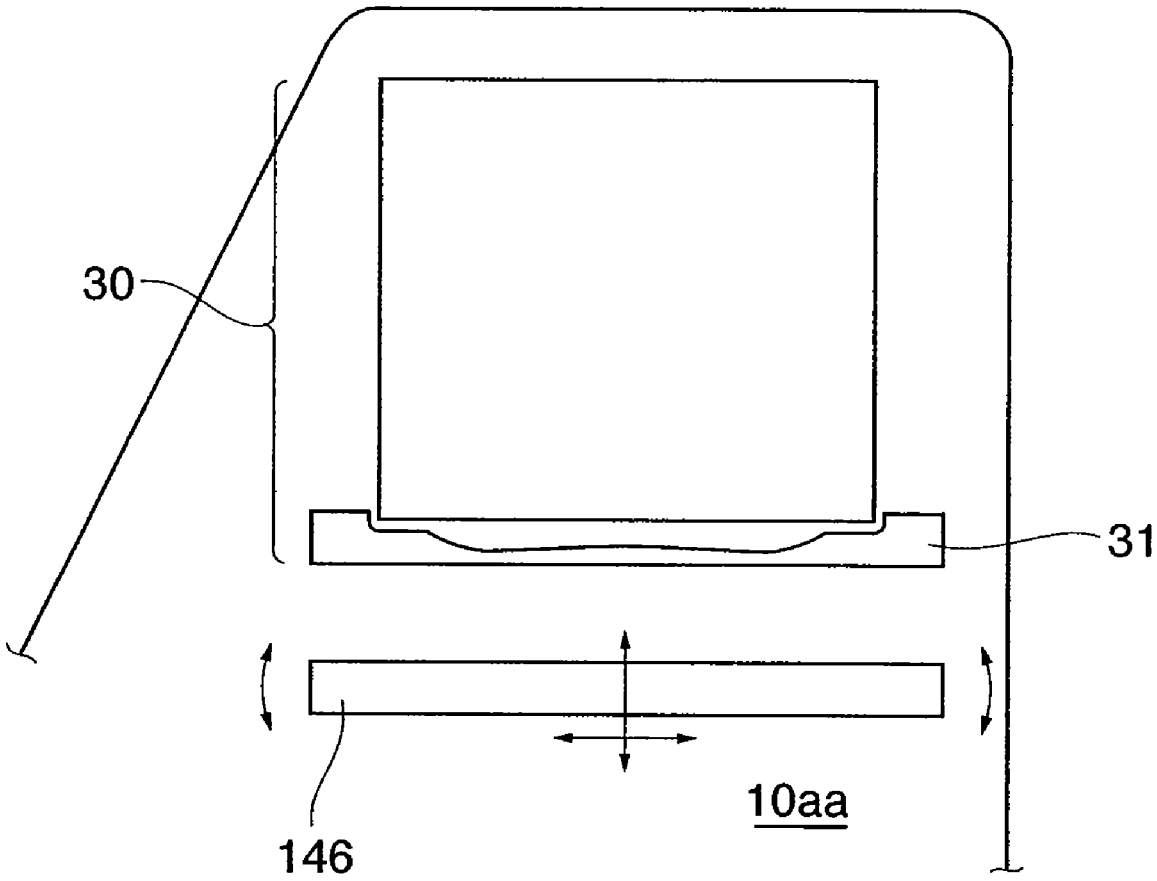
FIG. 4 is a schematic fragmentary section view showing the internal construction of a body of a musical instrument according to a modification of the embodiment.

For instance, in a modification shown in FIG. 4, a plate-like displacement member 146 is provided close to tone plates 31 which are disposed in a lower part of the tone generator unit 30. The displacement member 146 is operable in a musical performance by means of an operating device, not shown. Specifically, the displacement member 146 is configured for at least one of horizontal movement, vertical movement, back-and-forth pivotal movement, and left-and-right pivotal movement. With this configuration, sound varying effects similar to the aforementioned ones can be attained.

The opening whose open state can be varied by a member such as the front fallboard assembly 40 is not limited to one that permits the accommodation space 10*aa* to open toward the player. Such opening may be configured to permit the accommodation space 10*aa* to open toward the upward, sideward and/or rearward direction. Furthermore, the aforementioned member, which is used alternative to the front fallboard assembly 40 or the like, may be disposed at a location determined according to the position of the opening.

In the present embodiment, the effective open state of the front opening OP0 (refer to FIG. 1) is varied using the front fallboard 44 in combination with the rear fallboard 46. This is not limitative. For instance, the open state of the front opening OP0 may be varied using at least one of the front and rear fallboards. Alternatively, the open state thereof may be varied by using another member adapted to be drivingly operated and provided separately from the fallboard unit UNT.

In FIG. 2, the fallboard halfway open state of the fallboard unit UNT is shown by way of example. This illustration is one example of such state. The front end limit position of a range in which the fallboard unit UNT is movable may be shifted toward the fallboard closing direction than that shown in FIG. 2.

The operating device for driving the rear fallboard 46 is not limited to the front fallboard assembly 40. The operating device may be provided independently of and separately from the front fallboard assembly 40, so as to operate the rear fallboard 46 or the entirety of the fallboard unit UNT. In that case, the operating device may be a foot-operated pedal, for instance.

As a sound generating source in which sounds are varied using a displacement member such as the rear fallboard 46, the tone generator unit 30 has been shown by way of example that is comprised of the tone plates 31 and the resonance box 32. This is not limitative. The sound generating source may be a box-like one whose sound generating points are collected within a narrow range relative to sound boards or strings. For example, the box-like sound generating source may be comprised of a speaker and a speaker box.

The present invention is also applicable to glockenspiels and musical instruments other than keyboard instruments.

What is claimed is:

1. A keyboard-type musical instrument comprising:

a keyboard-type musical instrument body having an inside;

a plurality of performance operators provided in said musical instrument body;

a box-shaped sound generation unit, accommodated in the inside of said musical instrument body, for generating a sound in response to any one of said plurality of performance operators being operated;

a rear fallboard displaceable relative to said musical instrument body, at least part of said rear fallboard being always disposed within the inside of said musical instrument body;

a front fallboard that covers said plurality of performance operators and causes said rear fallboard to be displaced, said front fallboard being coupled to said rear fallboard such that the rear fallboard is displaced in unison with said front fallboard when the front fallboard is operated, wherein operating said front fallboard causes said rear fallboard to be displaced thus forming an opening between said rear fallboard and said performance operators through which a sound generated from said sound generation unit is emitted to an outside of said musical instrument and causes the size of the opening to be changed as the front fallboard is operated from a closed state to a full open state.

2. The musical instrument according to claim 1, wherein said musical instrument body is provided with a plurality of percussion units that correspond to respective ones of said plurality of performance operators and are each driven in response to a corresponding one of said plurality of performance operators being operated, said sound generation unit is comprised of a plurality of sounding members provided so as to correspond to respective ones of said plurality of percussion units and a resonance box for causing a musical tone produced from any one of said plurality of sounding members to resonate therein, said resonance box having an opening side, each of said plurality of sounding members vibrates and sounds a musical tone of a specific tone pitch when struck by a corresponding one of said percussion units in response to a corresponding one of said plurality of performance operators being operated, and said resonance box is arranged to have the opening side thereof disposed close to said sounding members.

3. A keyboard-type musical instrument comprising:

a keyboard-type musical instrument body having an inside;

a plurality of performance operators provided in said musical instrument body;

a box-shaped sound generation unit, accommodated in the inside of said musical instrument body, for generating a sound in response to any one of said plurality of performance operators being operated;

a rear fallboard displaceable relative to said musical instrument body, at least part of said rear fallboard being always disposed within the inside of said musical instrument body;

at least one opening formed between said rear fallboard and said performance operators through which a sound generated from said sound generation unit is emitted to outside; and a front fallboard connected to said rear fallboard such that the rear fallboard is displaced in unison with said front fallboard when said front fallboard is operated, and wherein displacement of said rear fallboard varies the size of said opening through which a sound generated from said sound generation unit is emitted to an outside of said musical instrument and causes, as a sound is generated from said sound generation unit, a variation in the quality and volume of the sound.

4. The musical instrument according to claim 3, wherein said musical instrument body is provided with a plurality of percussion units that correspond to respective ones of said plurality of performance operators and are each driven in response to a corresponding one of said plurality of performance operators being operated, said sound generation unit is comprised of a plurality of sounding members provided so as to correspond to respective ones of said plurality of percussion units and a resonance box for causing a musical tone produced from any one of said plurality of sounding members to resonate therein, said resonance box having an opening side, each of said plurality of sounding members vibrates and sounds a musical tone of a specific tone pitch when struck by a corresponding one of said percussion units in response to a corresponding one of said plurality of performance operators being operated, and said resonance box is arranged to have the opening side thereof disposed close to said sounding members.

* * * * *